US009228517B2

(12) United States Patent
Odendall

(10) Patent No.: US 9,228,517 B2
(45) Date of Patent: Jan. 5, 2016

(54) PROCESS FOR DETERMINING THE LAMBDA VALUE UPSTREAM FROM THE EXHAUST CATALYTIC CONVERTER OF AN INTERNAL COMBUSTION ENGINE

(75) Inventor: Bodo Odendall, Buxheim (DE)

(73) Assignee: AUDI AG, Ingolstadt (DE)

( * ) Notice: Subject to any disclaimer, the term of this patent is extended or adjusted under 35 U.S.C. 154(b) by 2632 days.

(21) Appl. No.: 11/392,799

(22) Filed: Mar. 30, 2006

(65) Prior Publication Data

US 2006/0218893 A1 Oct. 5, 2006

(30) Foreign Application Priority Data

Apr. 1, 2005 (DE) ..... 10 2005 014 955

(51) Int. Cl.
*F01N 3/00* (2006.01)
*F02D 41/14* (2006.01)

(52) U.S. Cl.
CPC ..... *F02D 41/1439* (2013.01); *F02D 41/1479* (2013.01)

(58) Field of Classification Search
USPC ..... 60/276, 285, 286, 287, 284
See application file for complete search history.

(56) References Cited

U.S. PATENT DOCUMENTS

| | | | | |
|---|---|---|---|---|
| 5,359,852 | A * | 11/1994 | Curran et al. | 60/274 |
| 5,901,552 | A * | 5/1999 | Schnaibel et al. | 60/274 |
| 6,253,542 | B1 * | 7/2001 | Omara et al. | 60/274 |
| 6,289,673 | B1 * | 9/2001 | Tayama et al. | 60/285 |
| 2004/0006973 | A1 * | 1/2004 | Makki et al. | 60/285 |
| 2004/0016229 | A1 * | 1/2004 | Schnaibel et al. | 60/286 |
| 2004/0182068 | A1 * | 9/2004 | Sun et al. | 60/274 |

FOREIGN PATENT DOCUMENTS

| | | |
|---|---|---|
| DE | 38 31 289 C2 | 5/1989 |
| DE | 40 01 616 C2 | 7/1991 |
| DE | 196 06 652 A1 | 8/1997 |
| DE | 103 07 010 B3 | 5/2004 |

* cited by examiner

*Primary Examiner* — Jesse Bogue
(74) *Attorney, Agent, or Firm* — Novak Druce Connolly Bove + Quigg LLP

(57) ABSTRACT

A process is proposed for determining the lambda value upstream from the exhaust catalytic converter in which variation in the lambda value ($\Delta\lambda$) from the stoichiometric value is determined on the basis of variation in the charging ($\Delta$OSC) of the oxygen reservoir (7) of the exhaust catalytic converter (6) and variation in the charging ($\Delta$OSC) of the oxygen reservoir (7) is ascertained from the voltage signal ($U_{\lambda,downstream}$) of a binary lambda probe (8) associated with the exhaust catalytic converter (6). In accordance with the proposal a control probe upstream from the exhaust catalytic converter can be omitted; this results in cost savings.

21 Claims, 2 Drawing Sheets

Figure 1:
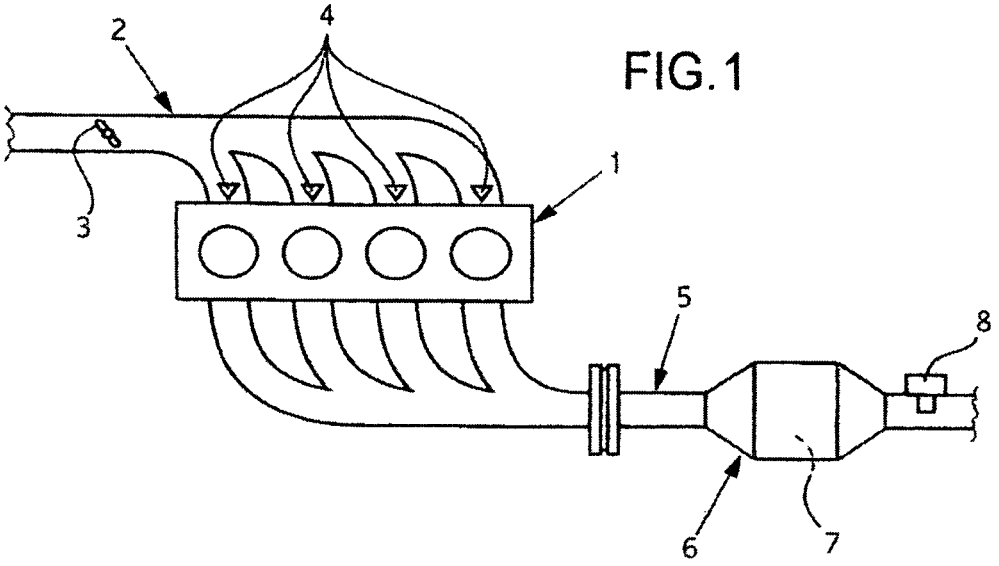

PROCESS FOR DETERMINING THE LAMBDA VALUE UPSTREAM FROM THE EXHAUST CATALYTIC CONVERTER OF AN INTERNAL COMBUSTION ENGINE

This application claims priority from German Application No. 102005014955.3, filed Apr. 1, 2005, herein incorporated by reference in its entirety.

The present invention relates to a process for determining the lambda value upstream from the exhaust catalytic converter of an internal combustion engine.

The lambda value upstream from an exhaust catalytic converter is usually determined by means of a suitably positioned control sensor. But if this control sensor is rejected for considerations of cost, the lambda value upstream from the exhaust catalytic converter may be determined only by observation of a model.

For example, the amount of air and amount of fuel introduced into the internal combustion engine may be determined from the parameters choke valve position and injection period and the resulting lambda value calculated on the basis of such determination. However, this procedure entails substantial tolerances, and their accuracy is accordingly unsatisfactory.

In this context the object of the present invention is preparation of an improved model consideration which on the basis of the available parameters permits sufficiently accurate determination of the lambda value upstream from the exhaust catalytic converter.

This object is attained in that the variation of the lambda value from the stoichiometric value is determined on the basis of change in charging of the oxygen reservoir of the exhaust catalytic converter and the change in charging of the oxygen reservoir is determined from the voltage signal of a binary lambda probe associated with the exhaust catalytic converter. This voltage signal is proportional within certain limits to the charging of the oxygen reservoir, so that the variation of the lambda value and ultimately the lambda value itself may be determined on this basis. The variation of the lambda value from the stoichiometric value of 1.0 and accordingly the lambda value upstream from the exhaust catalytic converter may be determined on the basis of increase or decrease in charging of the oxygen reservoir. In that the lambda value as thus defined may be determined with sufficient accuracy it is immediately possible to dispense with a control sensor mounted upstream from the exhaust catalytic converter and consequently reduce costs.

It is expedient for the variation in the charging of the oxygen reservoir to be determined from the gradient of the voltage signal.

A positive gradient of the voltage signal indicates removal of oxygen from the oxygen reservoir and accordingly a lambda value upstream from the exhaust catalytic converter which is smaller than the stoichiometric value of 1.0 and a negative gradient indicates introduction of oxygen into the exhaust catalytic converter which is greater than the stoichiometric value of 1.0.

In addition, the amount of the gradient of the voltage signal represents a gauge of the amount of oxygen introduced into or removed from the oxygen reservoir at this point in time. The difference between the lambda value in and stoichiometric value may ultimately be computed, so that the lambda value upstream from the exhaust catalytic converter may be determined with relative precision.

It is expedient for the voltage signal and/or the voltage signal gradient to be determined as a function of the exhaust mass flow moving through the exhaust catalytic converter.

The voltage signal of the lambda probe is a function of the exhaust mass as is charging of the oxygen reservoir.

A large exhaust mass flow through the exhaust catalytic converter is accompanied by rapid charging of the oxygen reservoir with oxygen or by rapid discharging of oxygen from the oxygen reservoir, the rate of charging and/or discharging of the oxygen reservoir being limited to a maximum value. Similarly, in the event of heavy exhaust mass flow the voltage signal of the lambda probe is displaced in the direction of lower values during charging and in the direction of higher values during discharging.

And correspondingly slow charging or discharging of the oxygen reservoir takes place in the event of a light exhaust mass flow through the exhaust catalytic converter. The voltage signal of the oxygen reservoir is displaced only slightly in the direction of higher or lower values and may even remain at the same level.

A relative charge of approximately 30% to 70% of the oxygen reservoir should be maintained in determination of the lambda value upstream from the exhaust catalytic converter, since only within this range are variation in the charging of the oxygen reservoir and the voltage signal of the binary lambda probe sufficiently proportional to each other. In addition, virtually complete conversion of the toxic components contained in the exhaust is possible only within this range in order that no undesirably high emission values occur during conduct of the process.

In addition or as an alternative, in determination of the lambda value the voltage signal of the lambda probe downstream from the exhaust catalytic converter should be considered only within its constant range, since only this constant range between Aswitching@ of the voltage signal from a rich to a lean exhaust composition allows precise association with a specific change in charging of the oxygen reservoir.

In addition, the gradient of the voltage signal within a specified range should be considered in determination of the lambda value, since the process is no longer sufficiently accurate even if the amount of the positive or negative gradient of the voltage value is too large.

Figure 2:
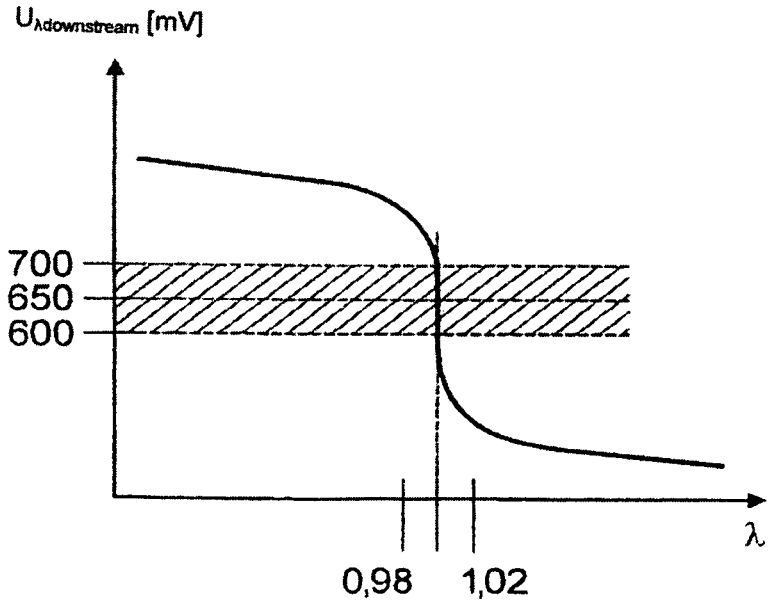
Figure 3:
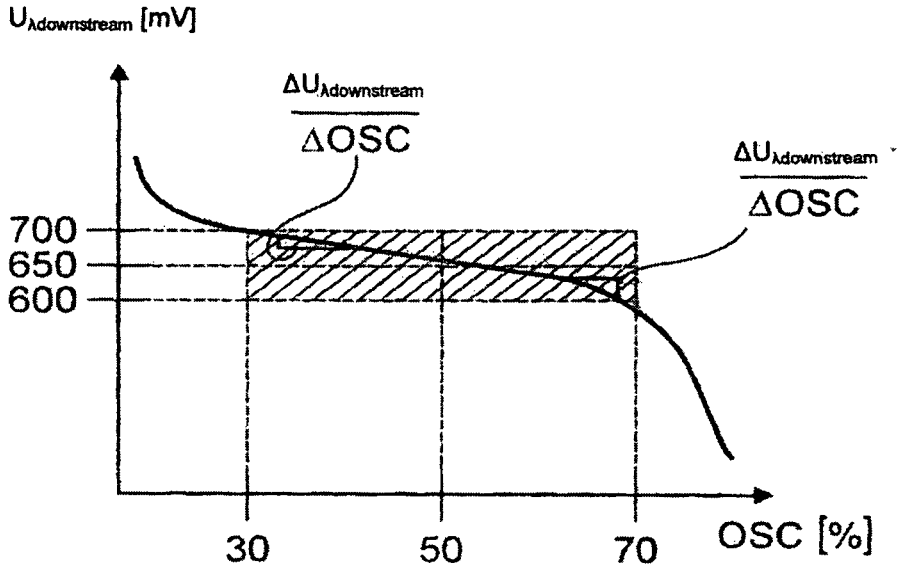
Figure 4:
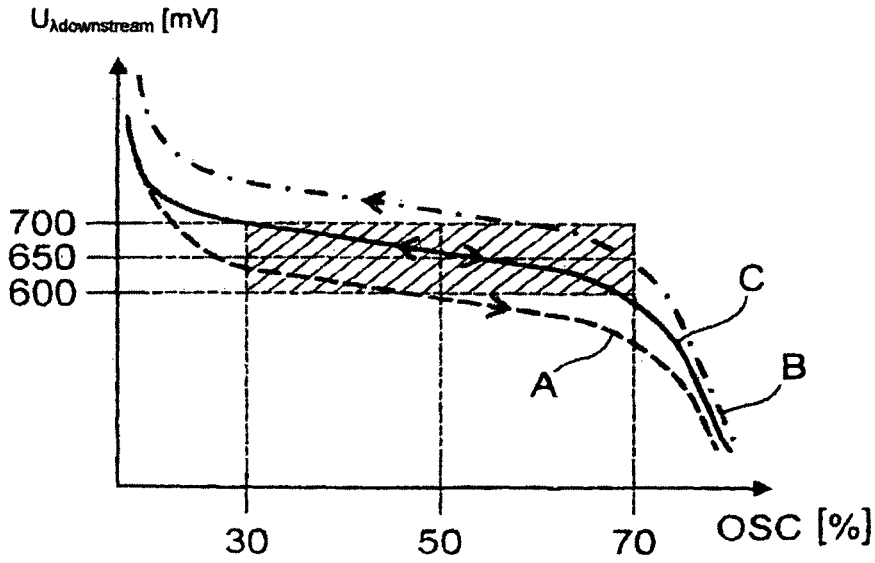

The invention will be described in what follows with reference to the drawing, in which FIG. 1 presents a diagram of an internal combustion engine with an exhaust catalytic converter;

FIG. 2 a first diagram, which illustrates the relationship between the voltage signal of the lambda probe and the air/fuel mixture of the exhaust flowing through the exhaust catalytic converter;

FIG. 3 a second diagram, which illustrates the relationship between the voltage signal of the lambda probe exhaust catalyst and charging of the oxygen reservoir of the exhaust catalytic converter; and FIG. 4 another diagram, which illustrates the relationship between the voltage signal of the lambda probe exhaust catalyst and charging of the oxygen reservoir with a heavy and a light exhaust mass flow.

The multicylinder internal combustion engine 1 shown in FIG. 1 has upstream in its intake manifold 2 a choke valve 3 and a number of fuel injection valves 4. In addition, the internal combustion engine 1 has downstream in its exhaust manifold 5 an exhaust catalytic converter 6 with an integrated oxygen reservoir 7 and a lambda probe 8 downstream from the exhaust catalytic converter 6.

The lambda probe 8 shown in FIG. 1 is a so-called jump probe, which, as is illustrated in FIG. 2, emits a high voltage signal $U_{\lambda downstream}$ when there is a rich air/fuel mixture in or downstream from the exhaust catalytic converter 6, a relatively low voltage signal $U_{\lambda downstream}$ when there is a lean air/fuel mixture, and in a range around $\lambda=1.0+/-0.02$ decreases steadily from high voltage to low voltage. In the process the lambda probe 8 employed measures at lambda $\lambda=0.99$, for example, a voltage signal $U_{\lambda downstream}$ of approximately 700 millivolts, at lambda $\lambda=1.01$ a voltage signal $U_{\lambda downstream}$ of approximately 600 millivolts, and with a stoichiometric air/fuel mixture or at lambda $\lambda=1.0$ a voltage signal $U_{\lambda downstream}$ of approximately 650 millivolts. Precisely this range of the voltage signal $U_{\lambda downstream}$ of 600 to 700 millivolts may be used for favorable conversion of the exhaust components.

FIG. 3 illustrates the relationship of the voltage signal $U_{\lambda downstream}$ of the lambda probe 8 to the charging OSC of the oxygen reservoir 7 of the exhaust catalytic converter 6. It is to be seen that the voltage signal $U_{\lambda downstream}$ of the lambda probe 8 is proportional over a wide range to the charging OSC of the oxygen reservoir 7 and rises sharply only within the lower range of the charging OSC of the oxygen storage OSC and drops sharply within the upper ranges of the charging OSC. Consequently, the gradient of the voltage signal $\Delta U_{\lambda downstream}/\Delta OSC$ is positive during unloading of the oxygen reservoir 7 and rises more sharply with increase in the discharge, while it is negative during charging of the oxygen reservoir 7 and decreases more sharply with increase in the OSC charging.

It follows that, for the sake of high accuracy of the process and acceptable conversion of the toxic components contained in the exhaust, charging OSC of the oxygen reservoir 7 is kept within the 30% to 70% range, voltage signal $U_{\lambda downstream}$ values within the constant range of approximately 600 to 700 millivolts are considered, and/or the voltage signal gradient $\Delta U_{\lambda downstream}/\Delta OSC$ is kept within a specified range.

FIG. 4 shows that the voltage signal $U_{\lambda downstream}$ of the lambda probe 8 depends both on the amount of deviation of the lambda value upstream from the exhaust catalytic converter 6 and on the exhaust mass flow m moving through the exhaust catalytic converter 6. Since the exhaust mass flow m affects charging or discharging of the exhaust catalytic converter 6, the voltage signal $U_{\lambda downstream}$ of the lambda probe 8 is also automatically affected. Thus, a heavy exhaust mass flow m as illustrated by line A indicates displacement of the voltage signal $U_{\lambda downstream}$ toward lower voltages during charging of the oxygen reservoir 7 and, as illustrated by line B, displacement of the voltage signal $U_{\lambda downstream}$ toward higher voltages during discharge of the oxygen reservoir 7. Only when the exhaust mass flow m is sufficiently small do the charging and discharging of the oxygen reservoir 7 remain unaffected, and then the pattern of the voltage signal $U_{\lambda downstream}$ for charging and that for discharging of the oxygen reservoir 7 of the exhaust catalytic converter 6 coincide.

Lastly, variation of the lambda value $\Delta\lambda$ from the stroichiometric value of 1.0 and accordingly variation proportional to it of the lambda value $\lambda$ upstream from the exhaust catalytic converter 6 may ultimately be determined with the utmost accuracy from variation in the voltage signal $\Delta U_{\lambda downstream}$ and accordingly variation in the charging $\Delta OSC$ proportional to it of the oxygen reservoir 7, the exhaust mass flow m, and time t.

$$\Delta OSC = const.\Delta U_{\lambda downstream}$$

$$\Delta\lambda = \Delta OSC/tm$$

$$\lambda = 1.0 + \Delta\lambda$$

List of Reference Symbols

1 internal combustion engine
2 intake manifold
3 choke valve
4 injection valve
5 exhaust manifold
6 exhaust catalytic converter
7 oxygen reservoir
8 lambda probe
OSC charging of oxygen reservoir
$\Delta OSC$ variation in oxygen reservoir charging
$U_{\lambda downstream}$ voltage signal of lambda probe
$\Delta U_{\lambda downstream}$ variation of voltage signal of the lambda probe
$\Delta U_{\lambda downstream}/\Delta OSC$ voltage signal gradient
t time
$\lambda$ lambda
$\Delta\lambda$ variation in lambda
m exhaust mass flow

The invention claimed is:

1. A process comprising calculating variation of a lambda value upstream from an exhaust catalytic converter, wherein the variation in the lambda value is calculated in reference to a stoichiometric value, wherein the variation of the lambda value is calculated on the basis of variation in the charging of an oxygen reservoir of the exhaust catalytic converter, and wherein variation in the charging of the oxygen reservoir is ascertained from a voltage signal of a binary lambda probe downstream from the exhaust catalytic converter; and adjusting an air to fuel ratio for an internal combustion engine based at least in part on the variation in the lambda value.

2. The process as claimed in claim 1, wherein the variation in the charging of the oxygen reservoir is calculated from the gradient of the voltage signal.

3. The process as claimed in claim 1, wherein the voltage signal and accordingly the gradient of the voltage signal are calculated as a function of the exhaust mass flow moving through the exhaust catalytic converter.

4. The process as claimed in claim 1, wherein the charging of the oxygen reservoir is considered within a range of 30% to 70%.

5. The process as claimed in claim 1, wherein the voltage signal of the lambda probe associated with the exhaust catalytic converter is considered within its constant range.

6. The process as claimed in claim 1, wherein the gradient of the voltage signal is considered within a specified range.

7. The process as claimed in claim 2, wherein the voltage signal and accordingly the gradient of the voltage signal are calculated as a function of the exhaust mass flow moving through the exhaust catalytic converter.

8. The process as claimed in claim 7, wherein the charging of the oxygen reservoir is considered within a range of 30% to 70%.

9. The process as claimed in claim 7, wherein the voltage signal of the lambda probe associated with the exhaust catalytic converter is considered within its constant range.

10. The process as claimed in claim 3, wherein the charging of the oxygen reservoir is considered within a range of 30% to 70%.

11. The process as claimed in claim 3, wherein the voltage signal of the lambda probe associated with the exhaust catalytic converter is considered within its constant range.

12. The process as claimed in claim 2, wherein the gradient of the voltage signal is considered within a specified range.

13. The process as claimed in claim 3, wherein the gradient of the voltage signal is considered within a specified range.

14. The process as claimed in claim 4, wherein the gradient of the voltage signal is considered within a specified range.

15. The process as claimed in claim 5, wherein the gradient of the voltage signal is considered within a specified range.

16. The process as claimed in claim 6, wherein the gradient of the voltage signal is considered within a specified range.

17. The process as claimed in claim 8, wherein the gradient of the voltage signal is considered within a specified range.

18. The process as claimed in claim 9, wherein the gradient of the voltage signal is considered within a specified range.

19. The process as claimed in claim 1, wherein the variation in the charging of the oxygen reservoir is ascertained when the voltage signal of the binary lambda probe is proportional to the charging of the oxygen reservoir.

20. The process as claimed in claim 1, wherein the variation in the charging of the oxygen reservoir is ascertained when the charging of the oxygen reservoir is from 30 to 70% and the voltage signal of the binary lambda probe is from approximately 600 to 700 millivolts.

21. The process as claimed in claim 1, wherein the lambda value upstream from the exhaust catalytic converter is an exhaust lambda value.

* * * * *